United States Patent [19]

Schijf

[11] Patent Number: 4,644,724

[45] Date of Patent: Feb. 24, 1987

[54] SANDWICH PANEL AND END STRIPS THEREFOR AND ASSEMBLY OF SUCH SANDWICH PANELS

[75] Inventor: Hendrikus J. Schijf, St. Amandsberg, Belgium

[73] Assignee: Contractual Services (Jersey) Ltd., Jersey, Channel Islands

[21] Appl. No.: 719,846

[22] Filed: Apr. 4, 1985

[30] Foreign Application Priority Data

Apr. 5, 1984 [GB] United Kingdom ..... 8408750

[51] Int. Cl.[4] ..... E04C 1/10

[52] U.S. Cl. ..... 52/588; 52/580; 52/785

[58] Field of Search ..... 52/785, 731, 802, 805, 52/578, 580, 588, 589, 593, 595

[56] References Cited

U.S. PATENT DOCUMENTS 1,995,477 3/1935 Kotrbaty ..... 52/580
2,495,862 1/1950 Osborn ..... 52/578 X
3,708,940 1/1973 Harman ..... 52/588
3,771,277 11/1973 Rausch et al. ..... 52/580 X
3,803,787 4/1974 Daggy ..... 52/580 X

FOREIGN PATENT DOCUMENTS 1013091 12/1965 United Kingdom ..... 52/588

*Primary Examiner*—Carl D. Friedman
*Assistant Examiner*—Naoko N. Slack
*Attorney, Agent, or Firm*—Pollock, Vande Sande & Priddy

[57] ABSTRACT

End strips for longitudinal edges of a sandwich panel to be used in facade cladding or in garage or entrance doors, the strips being provided with lugs which extend along the length of webs and each of which is arranged to engage with a lug of complementary shape on the other strip. Each lug is disposed on one side edge of the web with an adjoining flange which is disposed at least in part at an acute angle relative to the web, to co-operate with the adjoining cover plate of the sandwich panel.

4 Claims, 4 Drawing Figures

SANDWICH PANEL AND END STRIPS THEREFOR AND ASSEMBLY OF SUCH SANDWICH PANELS

BACKGROUND OF THE INVENTION

This invention relates to a sandwich panel and end strips for a longitudinal edge of a sandwich panel, comprising a web provided with a lug extending along the length of the web and arranged to engage with a lug of complementary shape on another strip.

Such sandwich panels are used in horizontal position to close access openings in factory buildings or garages, and can be hinged to one another by their strips and placed between rails which may extend in the horizontal direction above the access opening, so that, when raised, the panels can enter into the horizontally extending portion of the guide rails. The panels can also be used, in either vertical or horizontal position, as facade cladding. Various types of these panels are used as garage doors, and they usually consist of a U-shaped or H-shaped section provided with lugs capable of serving as hinges. The cover plates of the panel are then, however, placed behind the flanges of the end strips and foam plastic is cast into the interior space.

It is a shortcoming of these prior art strips that they must be fastened to the foam plastic over a very small area, whereas the full load of the panels must be able to be suspended on these strips. The strips are then also usually fastened with blind rivets through their flanges and the steel or aluminum cover plates behind them. Another shortcoming of these known end strips is that, during casting with foam plastic, the cover plates bulge out at the flanges because of their thickness, so that the panels are not taut on the outside.

SUMMARY OF THE INVENTION

The invention provides an end strip which need not be fastened to the panel with the aid of separate rivets or screws, while the cladding plates maintain a very taut panel exterior even after foam plastic has been cast into the interior.

It is another object of the present invention to provide an extremely light end strip, which nevertheless provides sufficient resistance to deflection as the result of wind pressure.

According to the invention, this is achieved with an end strip of the type described above, wherein the lug is disposed on one side edge of the web, with an adjoining flange which is disposed, entirely or partially, at an acute angle relative to the web.

According to the invention, the end strip is preferably so constructed that the web is likewise provided, on the side edge opposite to that where the lug is located, with a flange disposed, entirely or partially, at an acute angle relative to the web. In a preferred embodiment, the end strip is so constructed on one side that the flange disposed at an acute angle relative to the web is situated on that side of the web which is intended to face away from the sandwich panel, this flange merging at its free edge into a thickened portion of circular cross-section, the flange and the thickened portion together forming a lug, while on the other side it is so constructed that the web is shaped as part of a cylinder wall merging into a flange, the junction of the portion shaped as part of a cylinder wall with the flange being located in a position where the side surface of the sandwich panel is located. The invention therefore concerns an assembly of strips formed by one strip with a lug consisting of a flange with a thickened portion, and one strip with a lug in the form of a part of a cylinder wall, the portion of the one strip which is in the form of a cylinder wall fitting around the thickened portion on the flange of the other strip.

The invention further relates to a sandwich panel formed of two cover plates with filling material between them and, on both longitudinal edges, a strip, which panel according to the invention is so constructed that on one longitudinal edge there is disposed a strip having a lug in the form of a flange having a thickened portion and, on the other longitudinal edge, a strip having a flange in the form of a part of a cylinder wall. With these sandwich panels it is possible to form doors the panels of which can be hinged relative to one another with the aid of the strips.

BRIEF DESCRIPTION OF THE DRAWINGS

In order that the invention may be more clearly understood, reference will now be made to the accompanying drawings, wherein two embodiments of the invention are shown for purposes of illustration, and wherein.

DESCRIPTION OF THE PREFERRED EMBODIMENTS

Figure 1:
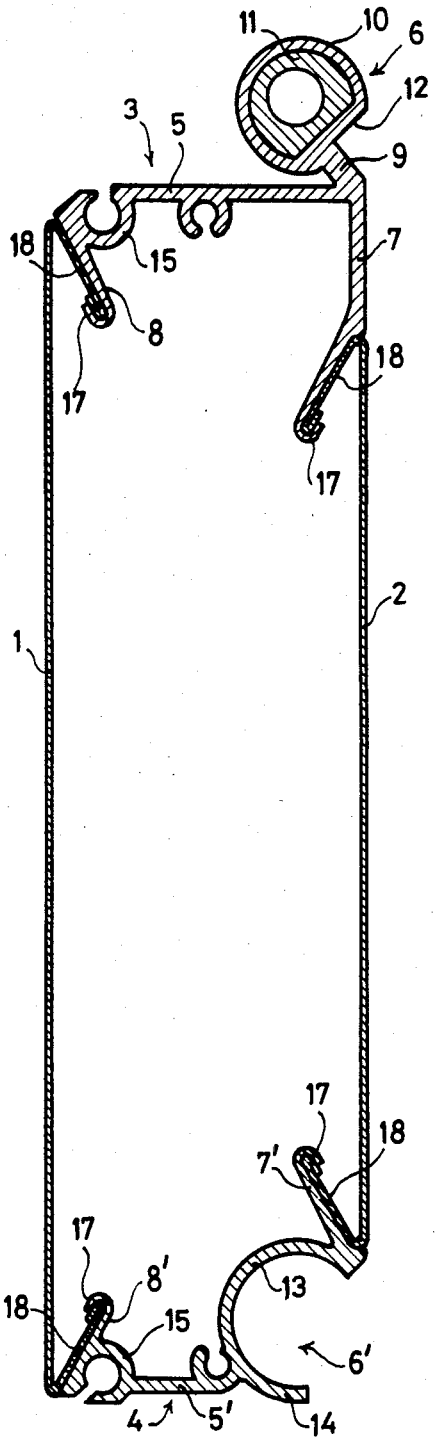
FIG. 1 is a cross-section through a sandwich panel provided with end strips according to the invention.
Figure 2:
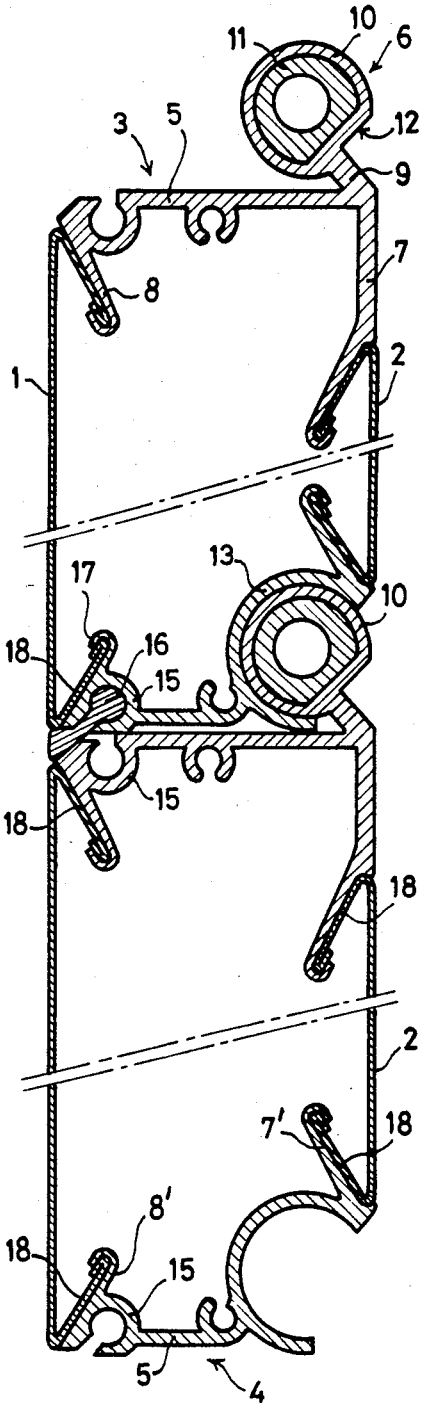
FIG. 2 is a cross-section through two adjoining panels which are hooked to one another with the aid of the end strips.
Figure 3:
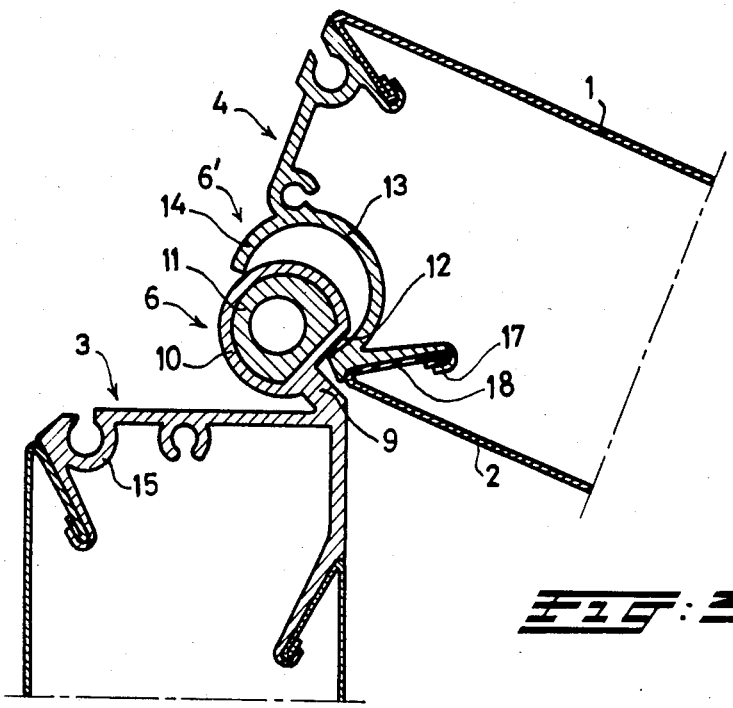
FIG. 3 shows a part of two panels, illustrating the hooking together of these panels.

For the sake of clarity, the cast foam plastic is omitted from the panel in FIG. 1. The panel is formed of a cover plate 1 of aluminum or steel on the outer side, and a plate 2, likewise of aluminum or steel or the inner side of a door which is to be assembled from these panels. The end strips for the longitudinal edges of the sandwich panel are referenced 3 for the top side, and 4 for the bottom side of the panel. Each end strip consists of a web 5, 5' and is provided with a lug 6 and 6' respectively, which extends along the length of the web 5, 5' and is arranged to engage with a complementarily shaped lug on the other strip, as can be seen in FIGS. 2 and 3. The lug 6 or 6' is disposed on one side edge of the web 5 or 5', with an adjoining flange 7 or 7', these flanges being disposed, entirely or partially, at an acute angle relative to the respective web 5 or 5'. The web 5, 5' is likewise provided, on its side edge opposite to that where the lug 6 or 6' is disposed, with a respective flange 8 or 8' entirely or partially disposed at an acute angle relative to the web. The end strip 3 is so constructed that the flange 9, which is disposed at an acute angle relative to the web 5, is situated on that side of the web 5 which is intended to face away from the sandwich panel, this flange 9 merging at its free edge into a thickened portion 10 of circular cross-section, this flange 9 and the thickened portion 10 together forming a lug 6. The thickened portion 10 is made hollow and a reinforcing tube 11 fits into it. The thickened portion 10 of circular cross-section is provided with a flattened portion 12 next to the flange 9, and this flattened portion forms a right angle with a flank of the flange 9 for a purpose which will be described later on. The web 5 of the strip 3 thus has three flanges 7, 8 and 9 disposed entirely or partially at an acute angle; one of these flanges (9) serves to form the lug 6, while the other two flanges 7 and 8 on the side of the web 5 opposite to that where the lug 6 is disposed are arranged for fastening to cover plates of the sandwich panel. The web 5' of the end strip 4 merges, by means of a part 13 of a cylinder wall, into a flange 7', while the junction of the part 13 in the form of a cylinder wall with the flange 7' lies in a position where the side face of the sandwich panel is situated. The part 13 formed in the shape of a cylinder wall is provided, next to the web 5' of the strip 4, with a freely projecting flange 14. The freely projecting flange 14 forms an extension of the web 5' and has a similar curvature forming a continuation of the part 13 in the form of a cylinder wall, this part also forming a lug 6' on the strip 4. On the side edge opposite that where the lug 6 or 6' is situated the web 5 or 5' merges, by means of a part 15 of a cylinder wall, into a respective flange 8 or 8'. The parts 15 serve to receive a sealing strip, for example of rubber, as denoted in FIG. 2 by numeral 16. On the side of the web which is intended to face the sandwich panel, the flanges 7, 8, 7' and 8' are provided at their free edges with a hookshaped portion 17 for a purpose which will be explained later on.

Thus the invention concerns an assembly of strips, as can be clearly seen in FIGS. 2 and 3, this assembly being formed by a strip 3 having a lug 6 consisting of a flange 9 with a thickened portion 10, and a strip 4 with a lug 6' in the form of a part 13 of a cylinder wall, the part 13 in the form of a cylinder wall of the one strip 4 fitting around the thickened portion 10 on the flange 9 of the other strip 3. The size of the lug 6 is so great that the lug 6' can be hooked around it only in the position shown in FIG. 3, which purpose is served by the flattened portion 12. This position, however, is far outside the hinge range of the two panels when they are in the position of use. A pin provided with a guide roller can be inserted into the reinforcing tube 11, and fits into guide rails near the side ends of the panels. The guiding of doors, consisting of panels, by means of a roller in rails is generally known and need not be described in greater detail.

From the foregoing it will be clear that the invention also relates to a sandwich panel formed of two cover plates 1 and 2, with filling material between them, and with respective strips 3 and 4 on the two longitudinal edges, one longitudinal edge being provided with a strip 3 having a lug 6 in the form of a flange 9 with a thickened portion 10, and the other longitudinal edge being provided with a strip 4 having a lug 6' in the form of a part of a cylinder wall. The cover plates 1 and 2 have turned-back edges 18, which lie against flanges 7, 8, 7' and 8' formed on the strips 3 and 4 and disposed at an angle relative to the web, and which engage by an edge with hook-shaped edges 17 of these flanges. Consequently it is not necessary to use additional fastening means in the form of rivets or screws after foam plastic has been cast into the cavity of the panel and expanded. Very taut panels are produced in this manner.

Figure 4:
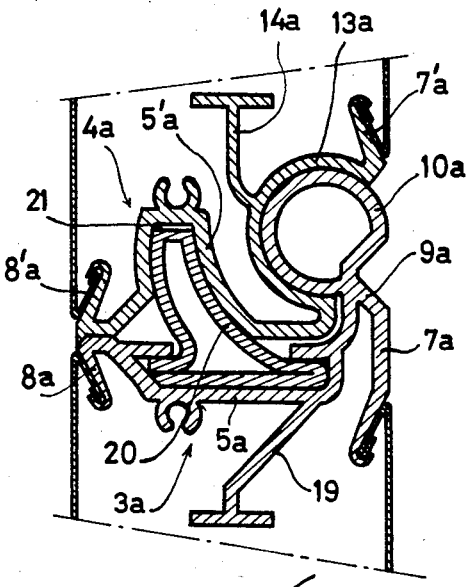
FIG. 4 is a cross-section through two adjoining end strips of another type, which is particularly suitable for the production of plastic end strips.

FIG. 4 shows a similar assembly of strips, which, however, instead of being made of, for example, extruded aluminum, may consist of extruded plastic. The respective components are given the same reference numerals as in FIGS. 1, 2 and 3, but followed by the letter "a". It is observed that the part 13*a* corresponding to a portion of a cylinder wall also has a freely projecting flange 14*a*, which lies close to the web 5'*a*, but in this case this flange 14*a* serves to ensure good fastening to the foam plastic. A similar flange 19 is disposed on the web 5*a* of the strip 3*a*. For reinforcement purposes the web 5*a* contains a chamber in which is disposed a comb-like reinforcing section 20 of metal. This comb-shaped section fits into a cavity 21 in the web 5'*a* of the sealing strip 4*a*. The cover plates are fastened in the same manner as previously explained with reference to FIGS. 1, 2 and 3.

The comb-like reinforcing section 20 of metal can also be made of plastic, and in such case the section 20 forms part of the web. The part of the web indicated by reference numeral 5*a* can then be omitted, as the comb-like section will also be filled with expanded foam plastic from the recess of the sandwich panel.

What is claimed is:

1. A sandwich panel adopted to be interconnected to a second similar panel, each panel being formed of two cover plates with filling material therebetween, and two end strips disposed at the longitudinal edges of said panels, each strip having a web provided with a lug extending along the length of said web for engagement with a lug of complementary shape on a strip of a said second panel, said lug being disposed on one side edge of said web and an adjoining flange at least part of which extends at an acute angle relative to said web, the web on the opposite side edge being provided with a further flange at least part of which extends at an acute angle relative to said web, the adjoining flange and the further flange each being disposed on the side of said web remote from said lug for the purpose of fastening said cover plates.

2. A sandwich panel as claimed in claim 1, wherein said adjoining flange and said further flange are provided with a hook-shaped portion at its free edge, and said cover plates have turned-back edges which lie against said adjoining flange and said further flange, respectively, and engage by an edge in said hook-shaped edges of said flanges.

3. A sandwich panel according to claim 1, wherein one of said end strips is provided with another flange disposed on that side of the web which faces away from said panel, the other flange merging at its free edge into a thickened portion of circular cross-section, said thickened portion near said other flange being provided with a flattened portion, which together with one flank of said other flange defines a right angle, and the web of said other end strip merges by means of a part-cylinder wall, which forms the lug of said strip, into said adjoining flange, the junction of said part-cylinder wall with said adjoining flange being positioned at the location of a side face of said sandwich panel.

4. A sandwich panel according to claim 3, wherein said part-cylinder wall is provided with a freely projecting flange near said web of said strip, said freely projecting flange forming an extension of said web and extending from the side face opposite to that on which said lug is disposed.

* * * * *